United States Patent [19]

Troendle, Sr.

[11] 4,416,100

[45] Nov. 22, 1983

[54] MODULAR WOODEN FLOOR UNITS AND METHOD OF MANUFACTURE THEREOF

[75] Inventor: Roy A. Troendle, Sr., New Orleans, La.

[73] Assignee: Troendle, Inc., New Orleans, La.

[21] Appl. No.: 299,334

[22] Filed: Sep. 4, 1981

[51] Int. Cl.[3] ..... E04F 15/022

[52] U.S. Cl. ..... 52/390; 52/384; 52/590

[58] Field of Search ..... 52/390, 391, 392, 747, 52/543, 586, 587, 592, 593, 595, 590, 384, 385, 389

[56] References Cited

U.S. PATENT DOCUMENTS

| | | | |
|---|---|---|---|
| 457,788 | 8/1881 | McKenzie . | |
| 1,622,104 | 3/1927 | Fulton | 52/390 |
| 1,925,068 | 8/1933 | Gray | 20/7 |
| 2,018,711 | 10/1935 | Elmendorf | 20/75 |
| 2,088,238 | 7/1937 | Greenway | 52/390 |
| 2,114,474 | 4/1938 | Labra | 2/18 |
| 2,151,505 | 3/1939 | Elemendorf | 52/389 X |
| 3,619,964 | 11/1971 | Passaro et al. | 52/309 |
| 4,170,859 | 10/1979 | Couniham | 52/392 X |
| 4,301,633 | 11/1981 | Neumann | 52/543 X |

FOREIGN PATENT DOCUMENTS

| | | | |
|---|---|---|---|
| 992801 | 10/1951 | France | 52/390 |
| 1099962 | 9/1955 | France | 52/391 |
| 497297 | 9/1954 | Italy | 52/390 |

*Primary Examiner*—John E. Murtagh
*Assistant Examiner*—Richard E. Chilcot, Jr.
*Attorney, Agent, or Firm*—Wilkinson, Mawhinney & Theibault

[57] ABSTRACT

The present disclosure is directed to a modular floor unit and method of making same. The module is made up of a plurality of lengths of tongue and groove strip flooring having a flat smooth finish on one side and a plurality of channel recesses on the other side. The tongue and groove strips are all of the same length and have the tongue of one strip full into the groove of an adjacent strip. The unfinished side is glued to a plywood back the grain of which is at a right angle to the length of the strips. After gluing the plywood is stapled to the back of the strips.

1 Claim, 4 Drawing Figures

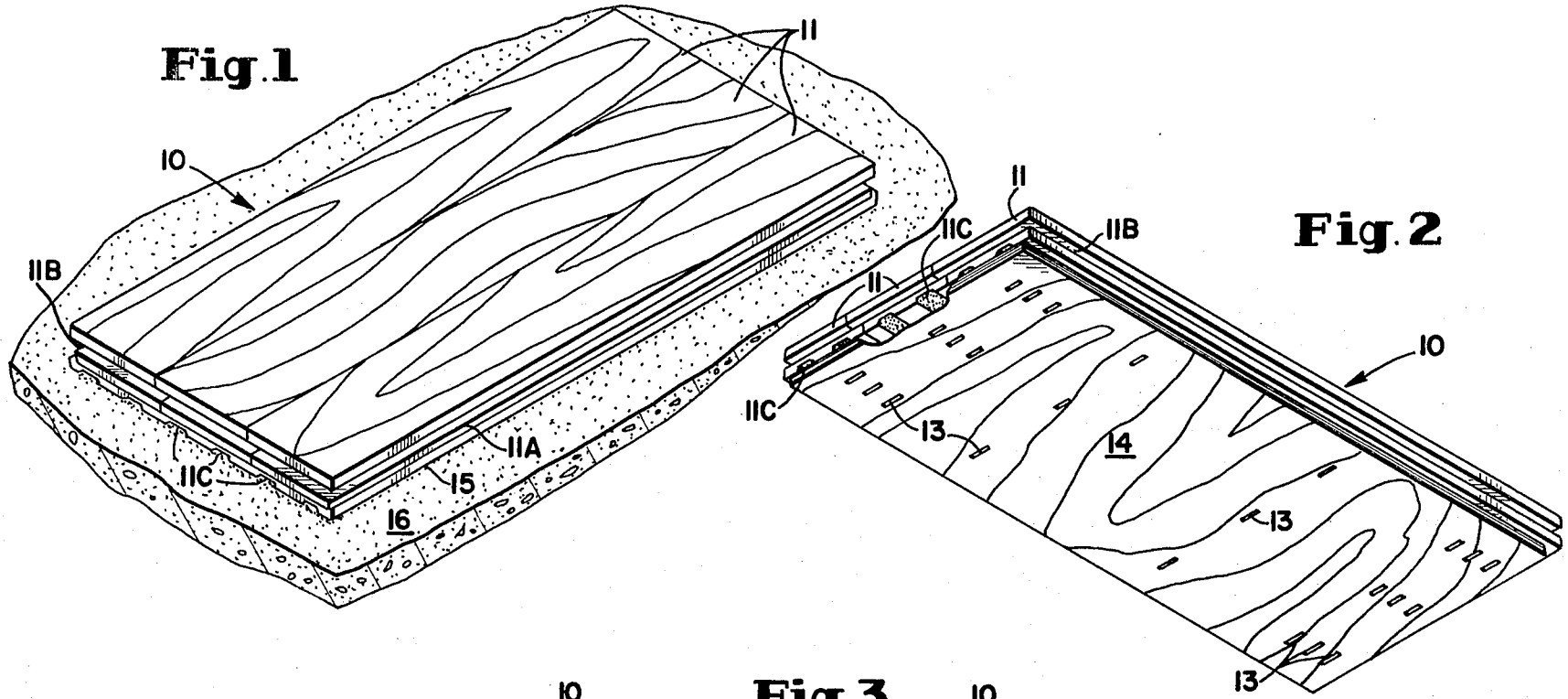
Fig. 1
Fig. 2
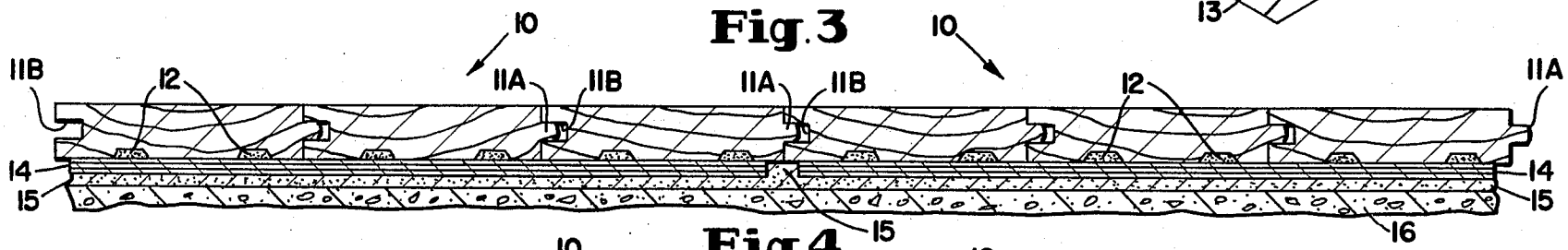
Fig. 3
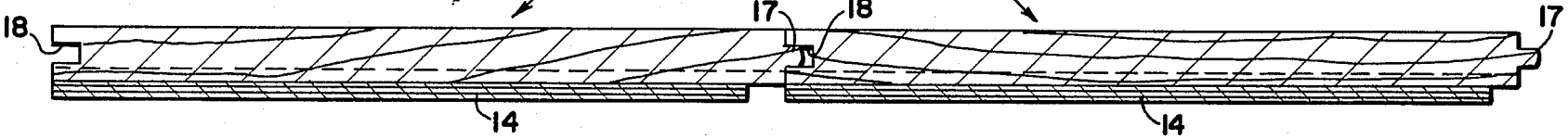
Fig. 4

MODULAR WOODEN FLOOR UNITS AND METHOD OF MANUFACTURE THEREOF

TECHNICAL FIELD

My invention relates to modular floor units and method of making same which are made up of lengths of tongue and groove floor finishing strips all of the same length glued to a plywood backing which in addition to being glued to the plywood are stapled thereto from the plywood side. The plywood is disposed to the stripping with its grain at right angles to the lengths of stripping.

BACKGROUND ART

Heretofore modular floor units have been made of wood surfaces and backing but none have been to my knowledge made as claimed herein. The closest prior art known to me at the time of filing this application are the following U.S. patents found on a search prior to filing. They are:

| | | |
|---|---|---|
| 457,788 | G. R. McKenzie | 1891 |
| 1,925,068 | M. Gray | 1933 |
| 2,018,711 | A. Elmendorf | 1935 |
| 2,114,474 | J. Labra | 1938 |
| 3,619,964 | F. Passaro et al | 1971 |

DISCLOSURE OF THE INVENTION

In accordance with my invention I prepare modules of wooden floor units employing a plurality of floor finishing strips of oak or a like hard wood which have a smooth finished side and a routed or channeled recess side opposite with longitudinal tongue and groove recesses along their edges. The strips are all of the same length and are arranged in groups of for example 3, 5 or 7 with the tongue and groove edges interlocked firmly and the unfinished grooved sides are glued with a water resistant glue to a plywood backing the grain of which is at a right angle to the strips. After gluing the strips and plywood backing the backing and strips are stapled from the plywood side. The ends of the modular units are cut and routed to provide transverse end tongue and groove connections for laying a plurality of the modules in a contiguous smooth flat uninterrupted floor surface.

BRIEF DESCRIPTION OF THE DRAWINGS

FIG. 1 is a top perspective view of a modular unit constructed in accordance with the present invention.

FIG. 2 is a perspective view of the underside of the module of FIG. 1.

FIG. 3 is a vertical transverse sectional view through a pair of interlocked modules of the present invention.

FIG. 4 is a vertical longitudinal section taken through a pair of interlocked modules.

The Best Mode for Carrying out the Invention

Referring now to the drawings, and for the moment to FIGS. 1 and 2, 10 designates a module which is composed of three pieces 11 of $2\frac{1}{4}'' \times \frac{3}{4}''$ tongue and grooved flooring which is 6 and $\frac{3}{4}''$ wide, 1" thick and which can be from 18" to 54" long. Each piece 11 has a pair of routed or recesses 11c for being glued at 12 and stapled at 13 to exterior plywood backing 14. The plywood is cut cross grain to give added strength to prevent warping. The modules can be installed in mastic 15 directly to a concrete floor 16.

The module is manufactured by selecting 2', 3', and 4' bundles of strip flooring. Three pieces 11 are selected. Lengths are selected to avoid waste. The three pieces of strip flooring 11 are placed upside down on press table. Three air cylinders operated by a hand valve, press the tongues on the length into a groove. This forms one square end with the tongues intact.

Another hand valve operates air cylinders that press the three pieces together at the same time. There are two stops at each end $6\frac{3}{4}''$ plus so that the pieces are straight and uniform in width.

Water resistant glue 12 is applied to the back of the three pieces of strip oak flooring 11. The $\frac{1}{4}''$ plywood 14 is cut $6\frac{1}{2}''$ to $6\frac{5}{8}''$ wide and placed over the strip flooring 11. The plywood 14 is squared on the tongue end. It is also recessed $\frac{1}{8}''$ so that when the module is installed in mastic, the mastic will not back up and prevent the floor from laying tight.

A third overhead cylinder carries three air staple guns. When a foot pedal is pressed, an air cylinder presses the plywood 14 to the three pieces of oak strip flooring 11 and when the safety trigger on the air guns touches the plywood, the three staple guns fire simultaneously. This is repeated approximately every 6 to 10 inches.

The uneven groove side of the three pieces of the module is passed through a roller arm saw. It is cut squared and immediately behind the saw blade, the module passes through a router and is grooved at 18 so that two adjacent interconnected modules are interlocked length-wise as shown in FIG. 4.

The method of laying the modules 10 has particular advantage in laying a wooden floor over a concrete subfloor.

The modules can be directly glued to concrete which give a plank and strip oak effect. The butts are staggered the same as if you were nailing a strip oak or plank floor. It is impossible to glue a strip or plank floor directly to concrete as individual strips would have bows and you would have nothing but cracks. My invention eliminates this problem because it is a uniformed module 10. It lays similar to a block or parquet floor in mastic.

The bonding glue 12 in the channel recesses and between said stripping and plywood is actually applied to the entire backing of the three pieces of flooring in the press. It is applied with a pressure glue applicator which operates with a squeeze valve and allows the glue to flow through a $6\frac{1}{2}''$ head with 3/32" holes which leaves beads of mastic, like a furrow.

The glue is a cross linking PVA glue which is used by all mill work shops to glue two pieces of wood together. It is similar to Elmer's and Wellwood's multipurpose glue sold in squeeze bottles. It is highly water resistant when stapled.

What is claimed:

1. A modular floor unit comprising a plurality of lengths of tongue and groove strip flooring having a flat smooth finish on one side and a plurality of channel recesses on their other side (a) said lengths of floor stripping all being of the same length and solid uniform thickness with the tongues inserted in the grooves, (b) a plywood backing member shorter than the length of said stripping and extending beyond one long end of said stripping on the side opposite the flat smooth finish side, the grain of said plywood being at a right angle to the longitudinal axis of the lengths of said strip flooring, (c) a bonding glue in said channel recesses between said stripping and said plywood, (d) a plurality of staple means connecting said plywood backing to said stripping, said staples entering said strip flooring from the plywood side, and (e) said modular unit of stripping having a tongue end across one end of said stripping and a grooved end across the opposite end.

* * * * *